United States Patent [19]

Gosanko et al.

[11] 4,144,661

[45] Mar. 20, 1979

[54] ADVERTISING DISPLAY DEVICE FOR NEWSPAPERS AND ANALOGOUS ARTICLES

[75] Inventors: Clarence Gosanko, Seattle, Wash.; Robert Weinberg, Beaverton, Oreg.

[73] Assignee: National Enquirer Inc., New York, N.Y.

[21] Appl. No.: 787,237

[22] Filed: Sep. 9, 1977

Related U.S. Application Data

[63] Continuation-in-part of Ser. No. 657,833, Feb. 13, 1976, Pat. No. 4,051,615.

[51] Int. Cl.[2] ..... G09F 3/18

[52] U.S. Cl. ..... 40/10 D; 40/16.2; 40/308

[58] Field of Search ..... 40/10, 308, 16, 10 D

[56] References Cited

U.S. PATENT DOCUMENTS

| | | | |
|---|---|---|---|
| 2,449,727 | 9/1948 | Sloane | 40/16 |
| 2,618,086 | 11/1952 | Komorous | 40/1.5 |
| 2,723,474 | 11/1955 | Minter | 40/308 X |
| 3,810,321 | 5/1974 | Kiba | 40/1.5 |
| 4,020,575 | 5/1977 | Kruger et al. | 40/1.5 |
| 4,051,615 | 10/1977 | Gosanko et al. | 40/10 D |

*Primary Examiner*—Louis G. Mancene
*Assistant Examiner*—Wenceslao J. Contreras
*Attorney, Agent, or Firm*—Michael J. Striker

[57] ABSTRACT

An advertising display device for displaying a newspaper or an analogous article on a wire rack includes a folded transparent element which has a generally rectangular front panel and a rear panel juxtaposed therewith so as to bound an interior space in which an article to be displayed is received. A plurality of mounting holes is provided at different locations on the rear panel for adjustably mounting the folded element at any of a plurality of positions relative to the wire rack. The article contained intermediate the panels is thus visible to a viewer at any selected one of these positions.

9 Claims, 3 Drawing Figures

FIG. 1
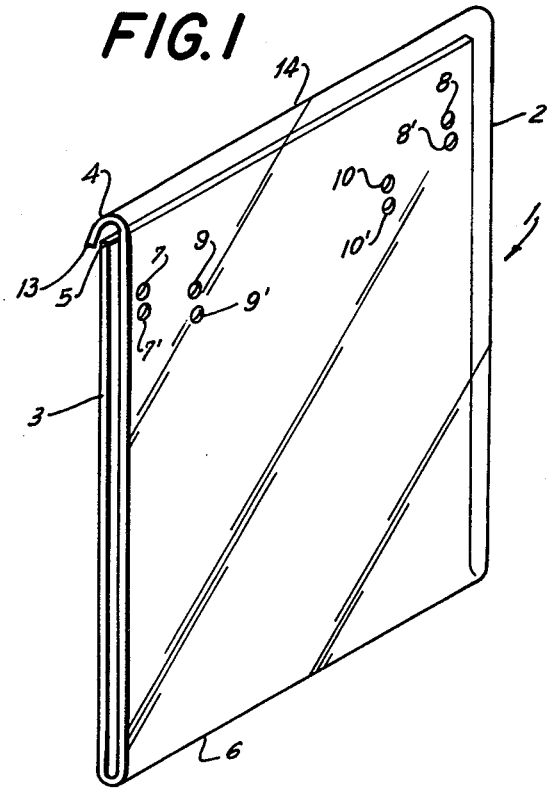
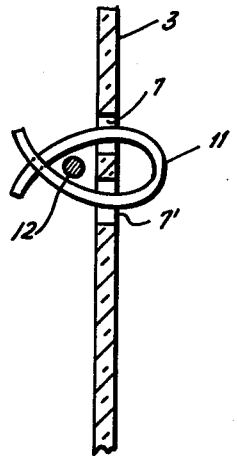
FIG. 3
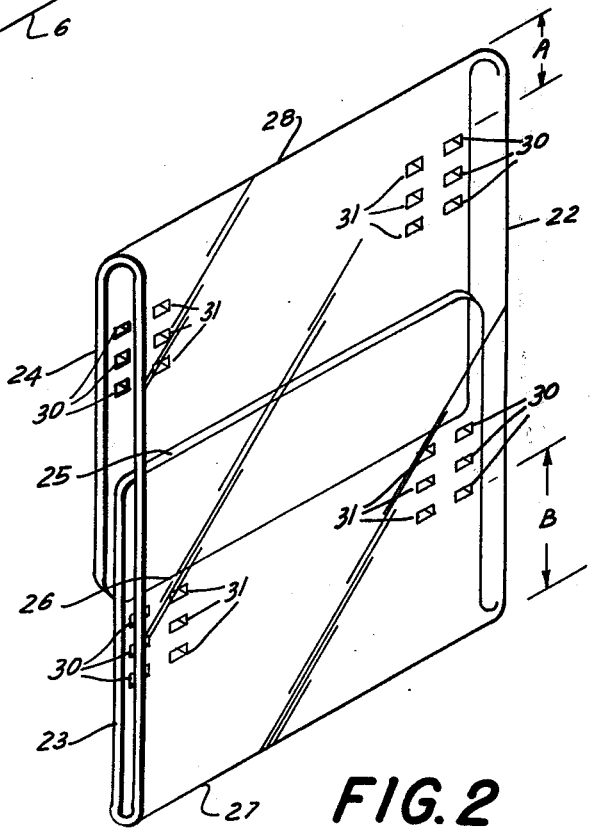
FIG. 2

ADVERTISING DISPLAY DEVICE FOR NEWSPAPERS AND ANALOGOUS ARTICLES

CROSS-REFERENCE TO RELATED APPLICATIONS

This application is a continuation-in-part application of our copending application Ser. No. 657,833, filed Feb. 13, 1976 now U.S. Pat. No. 4,051,615, for "Display Device and Arrangement for Newspapers and Analogous Articles."

BACKGROUND OF THE INVENTION

In order to sell newspapers, magazines and other analogous articles, they are frequently arranged horizontally in piles in various retail stores. However, this approach is not altogether adequate, since a buyer must actually walk over the horizontal piles to actually see the newspaper on display.

Thus, it has been further proposed to arrange newspapers vertically by placing them in racks. Such racks are generally filled with a plurality of newspapers, each newspaper being stacked on its end, one behind the other.

However, very serious difficulties have arisen in vertically displaying a newspaper to the public. It will be appreciated that newspapers are constituted of generally large-sized, non-stiff paper which are not self-supporting. Thus, vertically-arranged papers, and particularly the ones located in front of the vertical stack, tend to flop over so that the front page of the paper is not entirely visible to a buyer. As more and more newspapers are sold from a rack, this effect worsens since the newspapers located in the rear of the rack no longer provide any support for the newspapers located in the front. Without the buyer's attention being adequately directed to the front page of the newspaper, loss of sales will evidently occur.

Another difficulty in displaying newspapers in vertical orientation is that the presently commercially-available racks do not have the capability of displaying a newspaper at different positions, i.e. at different elevations relative to the ground. Such racks have newspaper-receiving pockets which are fixed in position relative to each other so that an advertiser cannot adjust the position of a newspaper to accommodate situations in which the viewing angles are different.

Still another drawback in displaying newspapers in vertical orientation is that other articles may be placed in the rack in front of the newspaper being sold. Such other articles will block one's view and, again, this results in loss of sales.

SUMMARY OF THE INVENTION

Accordingly, it is the general object of the present invention to overcome the disadvantages of the prior art.

An object of the present invention is to prominently display a newspaper or analogous article in a vertical orientation on a display rack at any selected one of a number of positions relative to the rack.

Another object of the present invention is to constantly display a newspaper or analogous article no matter how many such articles are sold from the rack.

An additional object of the present invention is to protect a newspaper or analogous article from possible damage.

Still another object of the present invention is to prevent a newspaper or analogous article from being blocked from view by other articles.

Still a further object of the present invention is to improve sales of newspapers and analogous articles.

In keeping with these objects and others which will become apparent hereinafter, one feature of the invention resides, briefly stated, in an advertising display device, particularly for displaying newspapers or analogous articles on a display rack, which comprises a folded element having a generally rectangular transparent front panel and a rear panel. The rear panel is juxtaposed with the front panel so as to bound an interior space in which an article to be displayed is received. The device also comprises means on the rear panel for adjustably mounting the folded element at any of a plurality of positions relative to the display rack. Such means includes a plurality of mounting holes arranged at different locations on the rear panel.

Thus, in accordance with the invention, as just described, the article contained intermediate the panels is visible to a viewer at any selected one of the aforementioned positions. Thus, an advertiser now has the capability of adjusting the position of a newspaper relative to the rack and also to the ground to thereby accommodate different viewing angles. Moreover, by mounting the device on the rack, such as a conventional wire rack, a newspaper or an analogous article is constantly displayed no matter how many articles may be sold from the rack. By placing the article intermediate the front and rear panels, the article will be protected against possible damage. Moreover, by mounting the display device in front of a rack, the newspaper or analogous article will not be blocked from view, as compared to the prior art, when other articles are placed in front of the newspapers inside the rack.

Another feature of the invention is to constitute the folded transparent element of substantially rigid but still slightly resilient, synthetic plastic material. This feature permits the rear panel to tightly press the article against the front panel so that the article is securely held in position and prominently displayed.

In accordance with one embodiment of the invention, the rear panel comprises a generally rectangular main portion, which is generally coextensive in area with the front panel, and a lip portion which generally extends towards the main portion and slightly overhangs a free edge of the latter. The lip portion cooperatively receives the free edge of the juxtaposed main portion of the rear panel with a snap-in and snap-out action. Thus, when a newspaper or analogous article is placed intermediate the panels, it will be pressed substantially flat, thereby imparting more prominence to the article itself.

In accordance with another embodiment of the invention, the rear panel comprises two portions, each having a generally rectangular configuration of area which exceeds one-half of the area of the front panel. Thus, these two portions overlap each other and also serve to press the article substantially flat intermediate the panels, for imparting more prominence to the article.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

FIG. 1 is a perspective view of one embodiment of the display device according to the present invention;

FIG. 2 is a perspective view of another embodiment of the display device according to the present invention; and FIG. 3 is a partial view in vertical section showing the mounting of a display device on a display rack.

DESCRIPTION OF THE PREFERRED EMBODIMENTS

Referring jointly to the display devices illustrated in FIGS. 1 and 2, it will be seen that reference numerals 1 and 21 generally identify a folded transparent element, preferably of substantially rigid but still slightly resilient synthetic plastic material, which is particularly useful for displaying newspapers or analogous articles on a display rack. The article to be displayed is located within the fold or interior space of such elements.

Turning now specifically to FIG. 1, element 1 comprises a generally rectangular front panel 2 and a rear panel juxtaposed therewith so as to bound an interior space in which the article to be displayed is received. The rear panel comprises a lip portion 4, and a main portion 3 which has a generally rectangular configuration formed with an area generally coextensive with the area of the front panel 2.

Both portions 3 and 4 are juxtaposed with front panel 2 such that the free edge 5 of main portion 3 and the free edge 13 of lip portion 4 form an open upper end at an upper region of element 1. Both portions 3 and 4 are joined along respective common unitary edges 6 and 14 with the front panel 2. The edge 6 formed by the main portion 3 forms a closed lower end at a lower region of the element 1 for holding the article intermediate the panels. At the upper region of element 1, the lip portion 4 forms a groove with the front panel 2. Since the folded element is of slightly resilient material, the groove is operative for receiving the free edge 5 of the movable main portion 3 with snap-type action so as to close the open upper end of element 1.

If an article, such as a newspaper, which is generally characterized by the fact that it is not self-supporting since it is made of relatively non-stiff paper, is placed intermediate the front and rear panels and, subsequently, the upper end of the element 1 is closed, then it will be seen that the article is effectively pressed flat by the front and rear panels and is fixedly held in position therebetween. This feature imparts more prominence to the article.

In order to adjustably mount the element 1 on a support, such as wire rack 12 as partially shown in section in FIG. 3, a plurality of mounting holes is formed on the main portion 3. These holes comprise a first set of two pairs of holes 7, 7' and 8, 8'. Each pair of holes is located at opposite sides of the main portion 3 and spaced at a first predetermined distance relative to each other. This first predetermined distance is selected to correspond to the location of separate wire portions of a conventional wire rack 12. We have found that a spacing of approximately nine and three-quarter inches to be adequate in most applications where the article to be displayed is about eleven inches in width by fifteen inches in height.

If smaller-sized racks are used, then a second set of two pairs of holes 9, 9' and 10, 10' may be used. The second set is located inwardly of the first set, and each pair of the second set is spaced from each other at a second predetermined distance which is relatively smaller than the first predetermined distance. In the purely exemplary example given above, this second predetermined distance would be approximately five and three-quarter inches.

FIG. 3 is a vertical cross-sectional view of a detail of FIG. 1 and illustrates a preferred way of mounting the element 1 onto the wire support 12. A strap 11 of synthetic plastic material, nylon, metal material or the like, is inserted through holes 7 and 7'. The strap 11 has a male plug at one end region which is inserted through a female socket provided at the other end region after the strap 11 has been looped around the wire 12 and tightened sufficiently. The strap 11 may be a conventional stay, as is commonly used in preventing wire from uncoiling.

Thus, in accordance with the invention, the position of the element 1 relative to the rack 12 is adjustable to any one of a plurality of positions in dependence upon the pairs of mounting holes selected. Thereby, the article contained within the element 1 is visible to a viewer at any selected one of these positions.

In the embodiment of FIG. 2, the folded element 21 comprises a generally rectangular, transparent front panel 22, and a transparent rear panel juxtaposed therewith so as to bound an interior space in which the article to be displayed is received. The rear panel comprises two overlapping portions 23 and 24, each being of generally rectangular configuration which is greater than one-half of the area of the front panel 22 so as to overlap each other in a central region of the element 21.

Both overlapping portions 23 and 24 are joined with the front panel 22 along respective common unitary edges 27, 28 which form closed ends. Both overlapping portions 23 and 24 are movable relative to each other so that their respective free edges 25, 26 can be moved apart of each other to permit an article to be received intermediate the panels, and towards each other to permit one of the overlapping portions, e.g. portion 23, to be received with snap-type action in the groove formed by the other overlapping portion, i.e. portion 24, with the front panel 22. As described above, the article will be pressed flat by the panels and also be held fixedly in position therebetween.

In order to adjustably mount the element 21 on a support, such as the wire rack 12, a plurality of mounting holes are formed on the overlapping portions 23, 24. These holes comprise two groups of two sets of three holes at opposite sides of the overlapping portions 23, 24. The two sets of group 30 are spaced at a predetermined distance from each other. The two sets of group 31 are spaced at a distance from each other which is smaller than the aforementioned predetermined distance of the two sets of group 30, i.e., group 31 is inwardly spaced from group 30. All of the mounting holes have a generally rectangular outline as compared with the circular outline of the holes of the element 1 of FIG. 1.

Moreover, the mounting holes on overlapping portion 24 are located at a distance A relative to the common edge 28 which is different from the distance B at which the mounting holes on overlapping portion 23 are located relative to the common edge 27. In FIG. 2, distance A is smaller than distance B.

In a currently preferred but purely exemplary embodiment, the front panel 22 is on the order of eleven inches wide and fourteen inches long. Distance A is approximately one and one-half inches; and distance B is approximately four inches. Each successive pair of holes in every set is approximately three-quarters of an inch apart. Each overlapping portion 23, 24 is approximately eleven inches wide by eight inches long.

The embodiment of FIG. 2 is mounted in a manner completely analogous to that disclosed in connection with FIG. 3. Two pairs of holes are selected on opposite sides of the element 21 and are strapped onto a support by straps 11. These pairs of holes may be selected on either overlapping portion. Thus, the position of the element 1 relative to the rack 12 is adjustable to any one of a plurality of positions in dependence upon the pairs of mounting holes selected. The article is thereby visible to a viewer at any selected one of these positions.

The support structure 12 is preferably of the wire rack type which is conventionally used in supermarkets for selling the National Enquirer Newspaper.

It will be understood that each of the elements described above, or two or more together, may also find a useful application in other types of constructions differing from the types described above.

While the invention has been illustrated and described as embodied in an advertising device for displaying newspapers and analogous articles, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A display device, particularly for displaing newspapers or analogous articles on a display rack, comprising a folded element having a transparent front panel and a rear panel juxtaposed therewith so as to bound an interior space in which an article to be displayed is received, said front panel having a generally rectangular configuration of predetermined area, said rear panel comprising a main portion forming a common unitary edge with said front panel, and a free edge, said main portion having a generally rectangular configuration of area generally coextensive with said predetermined area of said front panel, said rear panel also comprising a bent lip portion forming a groove for receiving the free edge of said main portion with snap-type action so as to press the article substantially flat intermediate said panels and impart more prominence to the article; and means on said rear panel for adjustably mounting said element at any one of a plurality of positions relative to the display rack so that the article contained intermediate said panels is visible to a viewer at any selected one of said positions, said means comprising one set of two pairs of holes, each pair being located at opposite sides of said main portion of said rear panel and being spaced at a predetermined distance from each other, and another set of two pairs of holes located inwardly of said one set at opposite sides of said rear panel, each pair of said other set being spaced at a predetermined distance from each other which is smaller than said first-mentioned predetermined distance.

2. A display device, particularly for displaying newspapers or analogous articles on a display rack, comprising a folded element having a transparent front panel and a rear panel juxtaposed therewith so as to bound an interior space in which an article to be displayed is received, said front panel having a generally rectangular configuration of predetermined area, said rear panel comprising two overlapping portions, each having a generally rectangular configuration of area generally greater than one-half of said predetermined area of said front panel so as to overlap each other and thereby press the article substantially flat intermediate said panels to thereby impart more prominence to the article; and means on said rear panel for adjustably mounting said element at any one of a plurality of positions relative to the display rack so that the article contained intermediate said panels is visible to a viewer at any selected one of said positions.

3. The display device as defined in claim 1, wherein said sets of holes are located on said main portion of said rear panel at different distances relative to said common unitary edge.

4. The display device as defined in claim 3, wherein said means for adjustably mounting said element further comprises means for strapping said element on to the rack, said strapping means including a pair of straps inserted through each pair of holes of at least one of said sets.

5. The display device as defined in claim 2, wherein said means for adjustably mounting said element comprises a set of two groups of three holes, each group being located at opposite sides of each of said portions of said rear panel, and said groups being spaced at a predetermined distance from each other.

6. The display device as defined in claim 5, wherein said means for adjustably mounting said element further comprises another set of two groups of three holes inwardly located of said one set at opposite sides of each of said portions of said rear panel, said two groups of said other set being spaced from each other at a predetermined distance which is relatively smaller than said first-mentioned predetermined distance of said two groups of said one set.

7. The display device as defined in claim 6, wherein each portion of said rear panel forms a common unitary edge with said front panel, and wherein said sets of holes on each of said portions of said rear panel are located at different distances from the respective common edges of the respective portions of the rear panel.

8. A display device for displaying newspapers or analogous articles on a display rack, comprising an elongated folded element of synthetic plastic material and having a generally rectangular transparent front panel of predetermined area, and a transparent rear panel having a lip portion and a main portion of generally rectangular configuration with an area generally coextensive with said predetermined area of said front panel, both of said portions being juxtaposed with said front panel such that respective free edges of the lip and main portions form an open upper end at an upper region of the element for receiving an article to be displayed, said main portion being joined along a common unitary edge with said front panel at a lower region of the element so as to form a closed lower end for holding the article intermediate said panels, and said lip portion being joined along another common unitary edge with said front panel so as to form therewith a groove for receiving the free edge of said main portion with snap-type action to thereby press the article substantially flat for fixing the position of the article intermediate the panels and for imparting prominence to the article; and means on said rear panel for adjustably mounting said element in upright orientation at any one of a plurality of positions relative to the display rack, said means including a plurality of pairs of mounting holes in the vicinity of said open upper end, said pairs being spaced at different distances from each other and being located at different distances relative to said common edges so that the position of the element and thereby of the article contained intermediate said panels is adjusted in dependence upon the particular pairs of mounting holes selected.

9. A display device for displaying newspapers and analogous articles on a display rack, comprising an elongated folded element of synthetic plastic material and having a generally rectangular transparent front panel of predetermined area, and a transparent rear panel having two overlapping portions each of generally rectangular configuration with an area generally greater than one-half of said predetermined area of said front panel, both of said overlapping portions being juxtaposed with said front panel so as to bound therewith an interior space in which an article to be displayed is received, and both of said overlapping portions being joined along respective common unitary edges with said front panel so as to form closed ends for holding the article intermediate said panels, one of said overlapping portions forming a groove with said front panel for receiving a free edge of the other of said overlapping portions with snap-type action to thereby press the article substantially flat for fixing the position of the article intermediate the panels and for imparting prominence to the article; and means on said overlapping portions of said rear panel for adjustably mounting said element in upright orientation at any one of a plurality of positions relative to the display rack, said means including a plurality of pairs of mounting holes in the vicinity of said closed ends, said pairs being spaced at different distances from each other and being located at different distances relative to said closed ends so that the position of the element and thereby of the article contained intermediate the panels is adjusted in dependence upon the particular pairs of mounting holes selected.

* * * * *